United States Patent [19]

Larson

[11] 4,446,894

[45] May 8, 1984

[54] GATE MAKING TOOL

[76] Inventor: Donald R. Larson, 12530 Dolan Ave., Downey, Calif. 90242

[21] Appl. No.: 375,886

[22] Filed: May 7, 1982

[51] Int. Cl.[3] ..... B21F 33/00

[52] U.S. Cl. ..... 140/57; 81/308; 29/268; 29/243.56

[58] Field of Search ..... 140/93 D, 123, 93.4, 140/106, 52, 56, 57, 102.5, 51, 49; 72/211; 29/267, 268, 243.5, 243.56; 81/303, 304, 308, 309, 310

[56] References Cited

U.S. PATENT DOCUMENTS

| | | | |
|---|---|---|---|
| 470,545 | 3/1892 | Cochran | 140/93 D |
| 705,504 | 7/1902 | Whipple | 140/51 |
| 894,301 | 7/1908 | Wharton | 140/51 |
| 2,036,140 | 3/1936 | Hansen | 29/243.56 |
| 2,565,646 | 8/1951 | Boyer et al. | 72/211 |
| 2,622,634 | 12/1952 | Hill | 140/49 |
| 3,385,326 | 5/1968 | Easton | 140/123 |

*Primary Examiner*—Francis S. Husar
*Assistant Examiner*—Linda McLaughlin
*Attorney, Agent, or Firm*—Ronald L. Juniper

[57] ABSTRACT

A clamping device specially structured to provide conformingly shaped jaws and precisely positioned, leveraged fingers adapted to bend metal fence-attaching clips into locking position around adjacent portions of wire fences and round gate posts.

9 Claims, 4 Drawing Figures

FIG. 1
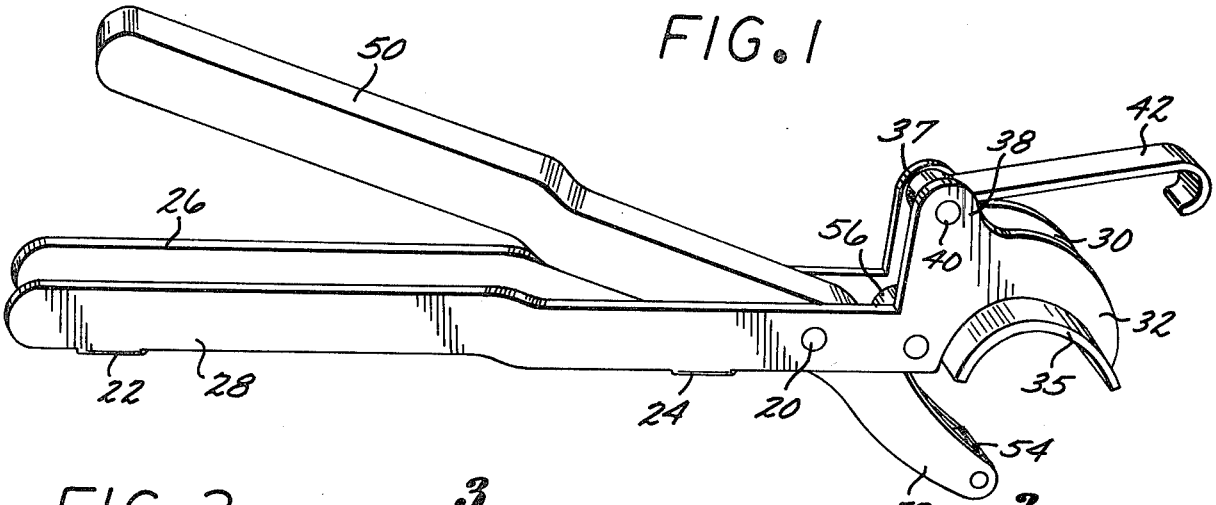
FIG. 2
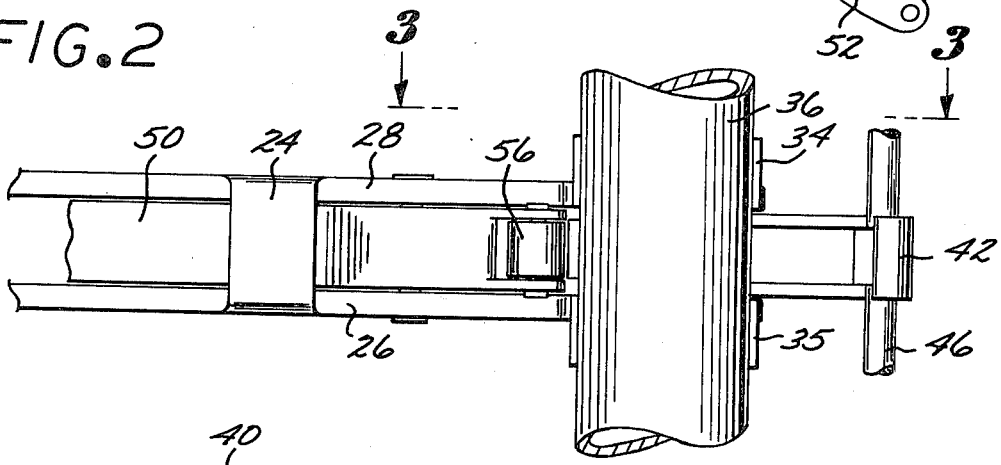
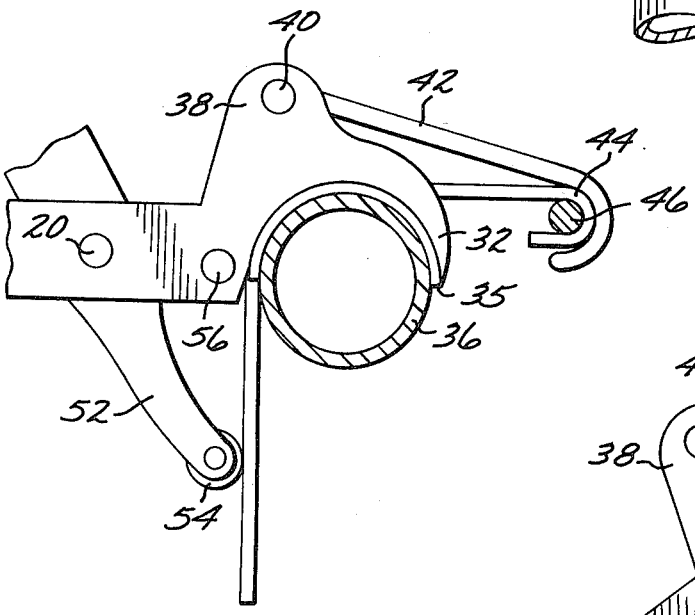
FIG. 3
FIG. 4
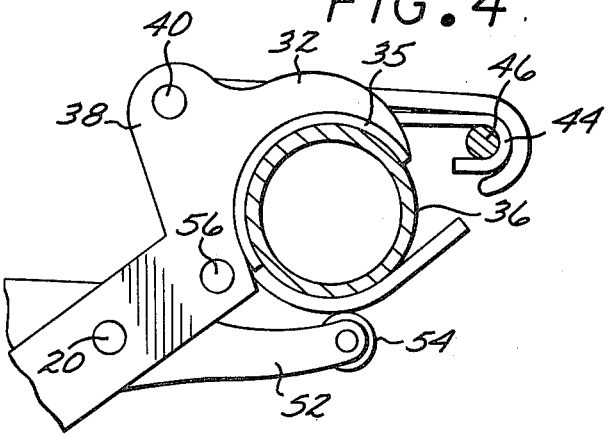

GATE MAKING TOOL

BACKGROUND OF THE INVENTION

This invention relates to the securing of heavy wire fences to posts. These types of fences are commonly used commercially and for other purposes requiring sturdy partitioning.

A difficulty in erecting such fences is encountered when securing the attaching clips to the different parts of the fence. Such clips are made of a heavy band of metal and require substantial effort to secure fence wires to posts such as used in gates.

Tools available to secure fence clips prior to this invention have been cumbersome to use and have not secured the clips as tightly as desired. Because of this lack of facility in securing fence clips, prior tools have been time-consuming in use. Thus, the time required to use these tools made extensive commercial use economically undesirable.

In order to solve these problems and to provide other advantages the subject invention was developed.

SUMMARY OF THE INVENTION

This gate making tool includes a hooking rod and a clip bender rod pivotally mounted together near one end. The positioning of this mounting pivot is such that the shorter end portions of these rods are shaped to provide gripping jaw action relative to each other as the handle portions of each of the rods are moved.

The gripping area of one of said jaws is formed as a concavely curved hemisphere shaped to conform with the curvature of a round gate post thereby providing a post holding jaw.

Also hingedly attached to an enlarged outer portion of this post holding jaw is a smaller fence clip holding stretch hook provided with an inwardly curved end adapted to hold a fence attaching clip around a fence wire.

The other jaw is provided with a small end roller in its gripping section to provide a smoothly engaging clip bending jaw. Also, an inner roller near the pivotal mounting of the rods provides a roller bearing surface in the back inner portion of the jaw. Thus, in use, the post holding jaw's inwardly curved portion is against a fence attaching clip mounted on a fence post and with the other end of the fence attaching clip engaged by the clip holding stretch hook. The fence attaching clip is curved around the outside of a fence post and pressed into locking engagement by the small end roller of the pressing clip bender jaw as the handles are closed.

DESCRIPTION OF THE DRAWINGS

FIG. 1 is an isometric side elevational view of the subject clamping device.

FIG. 2 is a fragmented bottom elevational view of the clamping device shown engaging and securing a fence clip around a fragmented portion of a fence wire and fence post.

FIG. 3 is a fragmented side elevational view of the clamping device as taken through plane 3—3 in FIG. 2 showing the fence starting to be engaged.

FIG. 4 is a view as in FIG. 3 with the jaws of the clamping device closed to secure a fence clip in place.

DETAILED DESCRIPTION OF THE INVENTION

Referring to the drawings, the basic elements of this invention include an elongated clip bender element and an elongated hooking element pivotally mounted together by a hinge pin 20. The hooking rod is formed as two spaced, matching, parallel aligned sections joined together by bridge brackets 22 and 24.

The longer sections of the hooking element form a hooking handle made up of handle elements 26 and 28 on one side of hinge pin 20 and concavely curving post holding jaw elements 30 and 32 on the other side of pin 20.

Secured within the curved inner edges of jaw elements 30 and 32 are split jaws 34 and 35, respectively, which are curved to conform with the circumferentially curved shape of a fence post 36. Each of the jaw elements 30 and 32 includes a portion formed as enlarged stretch hook pivot humps 37 and 38, respectively, on the outside of the jaws 34 and 35. Extending between these stretch hook pivot humps 37 and 38 is a stretch hook pivot 40 axially in a plane parallel with the axis of pin 20 and mounted so as to pivotally carry stretch hook 42.

Stretch hook 42 extends out like a curved finger matingly adapted to engage the curved outer end of a fence clip 44, which is, in turn, curved to engage a fence wire 46. Hook 42 is capable of pivoting through the space between the split jaws 34 and 35 and extends out beyond them.

Clip bender element is formed with a clip bender handle 50 which can be moved adjacent to the hooking handle elements 26 and 28 when the clip bender element is pivotally joined thereto by hinge pin 20. In size, handle 50 is somewhat shorter than hooking handle elements 26 and 28 and slightly narrower so that it can be moved to a closed position between hooking handle elements 26 and 28 limited by pressing against bridge elements 22 and 24.

Forward of hinge pin 20 the clip bender bar is formed as a relatively straight arm forming a clip bender jaw 52 which can be pivotally moved toward the post holding jaws 34 and 35 when the handles are pressed together. On the forward end of clip bender jaw 52 a pressure roller 54 is mounted for rotation. This roller 54 provides a means for applying smooth and firm pressure against a fence clip without damaging galvanized outer surfaces.

Mounted forward of hinge pin 20 within the jaw engaging area, but generally to the rear of post holding jaws 34 and 35, is a guide roller 46 mounted for rotation between the separated, spaced elements of the post holding bar.

The elements of this invention are shaped and spaced relative to each other so that, in use, a portion of a wire fence can be readily secured to a gate post by tightly clamping a metal fence clip around the adjacent parts. Thus, as best shown in FIG. 2 the small hook end of a fence clip 44 (which is to be attached around a fence wire 46) is engaged within the curved end finger of the stretch hook 42. The remainder of the fence clip 44 is laid over a fence post 36 which is also engaged by jaws 34 and 35. The fence clip 44 is held in place by inner bearing pressure of guide roller 56 next to the fence post 36. The extended outer end of the fence clip 44 is engaged by the pressure roller 54.

Thus, as the hooking handle and clip bending handle are grasped and closed together this moves the clip bender 52 to press against the clip 44 and bend it tightly around a fence post 36 as shown in FIG. 4. This smooth rolling pressure of the bearing element rollers 54 and 56 in combination with the pivotal stretch hook attachment and conformed holding arrangement of the hooking jaws provides a tightly controlled engaging action for uniquely securing fence hooks.

The a particular form of this invention has been shown and described in detail herein this is meant as illustrative of this development and not as a limitation thereof which comprehends all embodiments within the spirit of the following appended claims.

I claim:

1. A clamping device specially adapted to secure fence clips to wire fences and adjacent posts including:

(a) a hooking element provided with hooking jaw means adapted to hold a fence post;

(b) a stretch hook element hingedly mounted on said hooking element and positioned to hold a conformingly shaped fence clip which is, in turn, engaged with a fence wire and a fence post held by said jaw hooking means;

(c) a separate clip bender element having a clip bender arm pivotally connected with said hooking element, said arm adapted to press against a fence clip to engage it with a fence post held by said hooking element; and (d) two separate handle means connected to said hooking jaw means and said clip bender arm, respectively for closing said hooking jaw means and said clip bender arm together to form a gripping area which can bend a clip held therein tightly around an engaged fence wire and post.

2. A clamping device as defined in claim 1 wherein said stretch hook element is shaped like a finger curving in conformity over the curved end of a fence clip.

3. A clamping device as defined in claim 2 wherein said stretch hook element is hingedly engaged near said hooking jaw element.

4. A clamping device as defined in claim 1 provided with guide roller means mounted for rotation within said gripping area formed between said hooking jaw means and clip bender arm, wherein said guide roller is positioned on said clip bender arm to press against and facilitate smooth engagement of a fence clip held therein.

5. A clamping device as defined in claim 1 wherein said clip bender arm is provided with end roller pressure engaging means.

6. A clamping device as defined in claim 1 wherein said means for closing said hooking jaw and said clip bender arm together includes separate handle portions formed by each of said hooking and said clip bender elements which, when moved toward each other, causes the jaw portions thereof to provide a gripping means.

7. A clamping device as defined in claim 1 wherein said hooking element is formed as a pair of separate, spaced, essentially similar sections aligned in parallel planes.

8. A clamping device as defined by claim 7 wherein said clip bender element is pivotally mounted with said hooking element so that said clip bender arm can pass through the space between the separated sections of said hooking element.

9. A clamping device as defined by claim 8 wherein said stretch hook is aligned for parallel plane movement, relative to said hooking element and clip bender arm so that an engaged fence clip can pass through the space between said separated sections of said hooking elements while it is being held by said hooking elements and clip bender arm and be pressed by said clip bender arm into engagement around a fence post.

* * * * *